US010690021B2

(12) United States Patent
Cornell et al.

(10) Patent No.: US 10,690,021 B2
(45) Date of Patent: Jun. 23, 2020

(54) HOLLOW VALVE SPRING RETAINER

(71) Applicant: Ford Global Technologies, LLC, Dearborn, MI (US)

(72) Inventors: John Cornell, Allenton, MI (US); Mark Madin, Canton, MI (US); Joy Forsmark, Saint Clair Shores, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 95 days.

(21) Appl. No.: 16/000,293

(22) Filed: Jun. 5, 2018

(65) Prior Publication Data

US 2019/0368390 A1 Dec. 5, 2019

(51) Int. Cl.
*F01L 1/18* (2006.01)
*F01L 3/10* (2006.01)

(52) U.S. Cl.
CPC ..... *F01L 3/10* (2013.01)

(58) Field of Classification Search
CPC ..... F01L 1/462; F01L 3/10; F01L 2001/0537; F01L 2101/00; F01L 2101/02; F01L 2103/00; B33Y 80/00
See application file for complete search history.

(56) References Cited

U.S. PATENT DOCUMENTS

| | | | | |
|---|---|---|---|---|
| 1,761,943 | A | 6/1930 | Summers et al. | |
| 2,844,134 | A | 7/1958 | Sietman | |
| 4,321,894 | A | 3/1982 | Black | |
| 4,826,180 | A * | 5/1989 | Deuring | F01L 3/08 123/188.6 |
| 5,103,779 | A | 4/1992 | Hare, Sr. | |
| 5,322,039 | A * | 6/1994 | Kinsey | F01L 3/10 123/188.13 |
| 7,832,456 | B2 * | 11/2010 | Calnan | B22F 3/008 164/15 |

FOREIGN PATENT DOCUMENTS

EP 1741881 A2 1/2007

* cited by examiner

*Primary Examiner* — Zelalem Eshete
(74) *Attorney, Agent, or Firm* — Geoffrey Brumbaugh

(57) ABSTRACT

Methods and systems are provided for a valve spring retainer of a valvetrain assembly. In one example, valve spring retainer may be at least partially hollowed and include inner cavities forming channels within a material of the valve spring retainer. Air inside the inner cavities may be fluidly coupled to air surrounding the valve spring retainer through channels. A mass of the valve spring retainer may be decreased and a cost and speed of fabrication of the valve spring retainer may be reduced by additive manufacturing.

19 Claims, 5 Drawing Sheets

HOLLOW VALVE SPRING RETAINER

FIELD

The present description relates generally to retainers for retaining poppet valve springs.

BACKGROUND/SUMMARY

A camshaft of a valvetrain may control motion of a poppet valve, such as an intake or an exhaust valve in an engine. In addition to the valves and the camshaft, the valvetrain may also include rocker arms, pushrods, and lifters that couple the valves to the camshaft and translate rotational motion of the camshaft into linear motion of the valves. The components of the valvetrain may work in concert to control amounts of air and fuel delivered to a combustion chamber during engine operation. Lifting of the intake valve allows the air to enter the combustion chamber through an inlet port and, when released by the cam, the intake valve may close and block air flow. Similarly, when the exhaust valve is lifted, exhaust gas may flow from the combustion chamber to an exhaust manifold through an outlet port. The intake and exhaust valves may be adapted with a valve spring to seal the valve against a valve seat when adjusted to closed positions by the cam.

The valve spring may coil around a valve stem of the intake or exhaust valve between a cylinder head surface and a valve spring retainer. In an overhead camshaft orientation, the valve may be depressed by the cam, thereby compressing the valve spring and opening the valve. When closed, a spring load of the valve spring exerts pressure against the cylinder head surface and against the valve spring retainer to press the valve against the valve seat and block flow through the inlet or outlet port of the cylinder. To counter the spring load of the valve spring, a valve spring retainer may be arranged along the valve stem at an opposite end of the valve from the valve seat, resisting the force exerted by the valve spring so that the valve spring retainer is not displaced. In this way, the valve spring retainer may be anchored along the valve while expansion of the valve spring compels the valve to slide upwards into the closed position.

The spring load of the valve spring may depend upon an overall mass of the valvetrain. Components of the valvetrain, including the valve spring retainer, are typically formed from a durable, heat-resistant material, such as steel. Forming the valvetrain parts from a metal, however, may result in a heavy mass of the valvetrain and the spring load of the valve spring may be increased accordingly in order to maintain contact between the valve and a cam lobe of the camshaft. This may also increase friction within the valvetrain and lead to degradation of components. In particular, a positioning of the valve spring retainer at a top of the valve stem of either the intake or exhaust valve may increase stress on the valve.

Attempts to reduce the weight of the valvetrain include decreasing a mass of the valve spring retainer. One example approach is shown by Black in U.S. Pat. No. 4,321,894. Therein, a valve spring retainer is disclosed with a base that includes an aperture. The base also has a lip that projects downward to fit over and retain a valve spring. The valve spring retainer further includes a valve adjuster cap with threading that engages with threading in the base. Both the base and the adjuster cap are formed from thinner surfaces and less material than conventional, solid valve spring retainers. Thus an overall mass of the valve spring retainer is reduced.

However, the inventors herein have recognized potential issues with such systems. As one example, forming the valve spring retainer from two individual pieces, e.g., the base and the adjuster cap, increases a number of parts to be manufactured, thus raising production costs. In addition, by doubling the number of components of the valve spring retainer, labor and assembly time is increased for fabrication of the valve spring retainer.

In one example, the issues described above may be addressed by a valvetrain of an engine comprising a valve spring, a disc-shaped valve spring retainer having a central aperture and a plurality of inner cavities concentric with the central aperture, the retainer engaging with a first end of the valve spring. In this way, the valve spring retainer may be manufactured in a cost-effective manner as a single, unitary component with a reduced mass.

As one example, the valve spring retainer may be adapted with internal cavities so that the valve spring retainer is at least partially hollow. The internal cavities may form rings of air within a thickness of the valve spring retainer, with air inside the cavities coupled to air surrounding the valve spring retainer through channels. As a result of the hollow configuration, an amount of metal used to form the valve spring retainer is significantly reduced without affecting a structural integrity of the valve spring retainer. The retainer may be fabricated as a single unit by additive manufacturing, thus reducing production labor and time.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 3-5 are shown approximately to scale.

DETAILED DESCRIPTION

Figure 3:
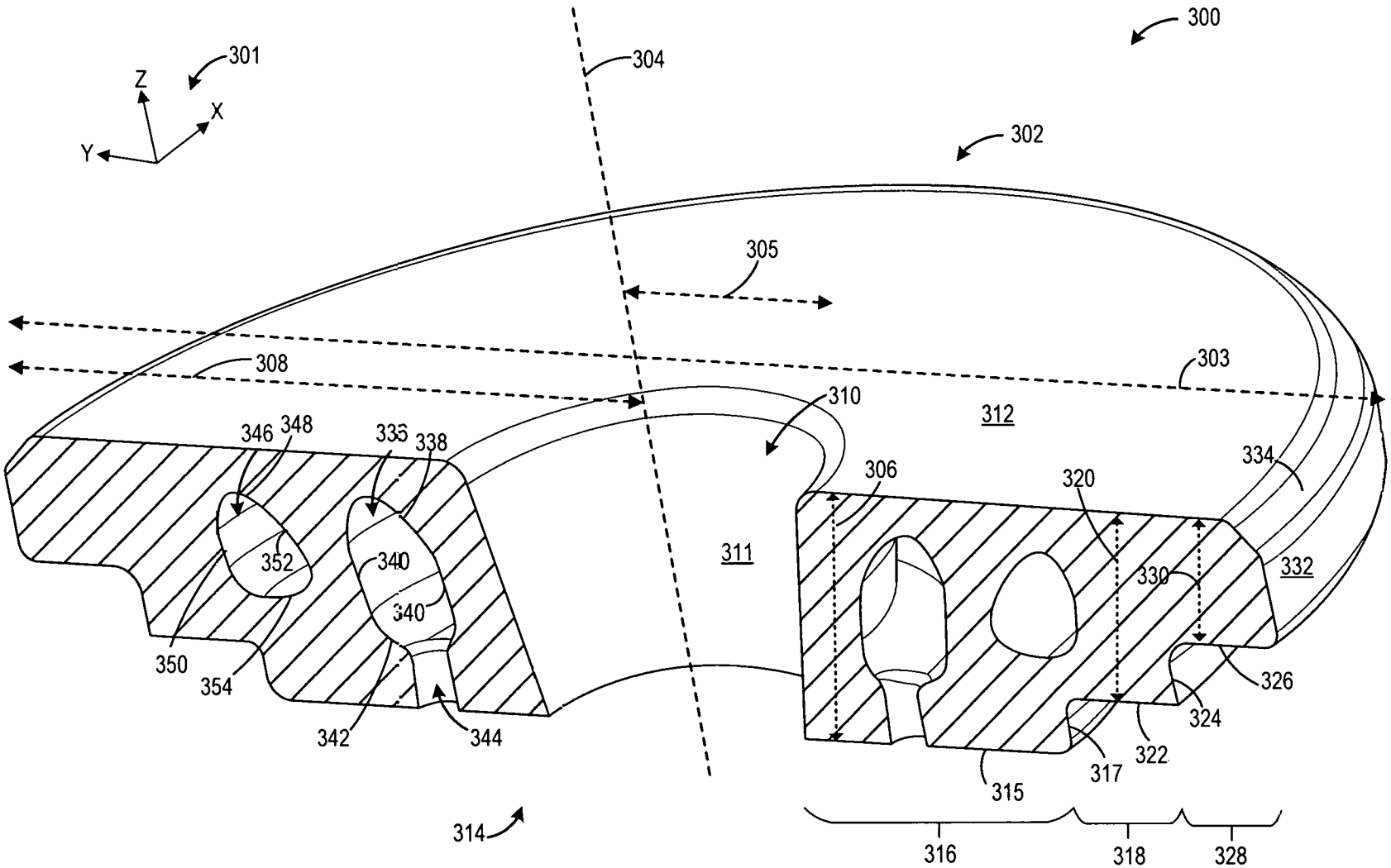
FIG. 3 shows a first cross-section of a hollow valve spring retainer from an isometric perspective view.
Figure 4:
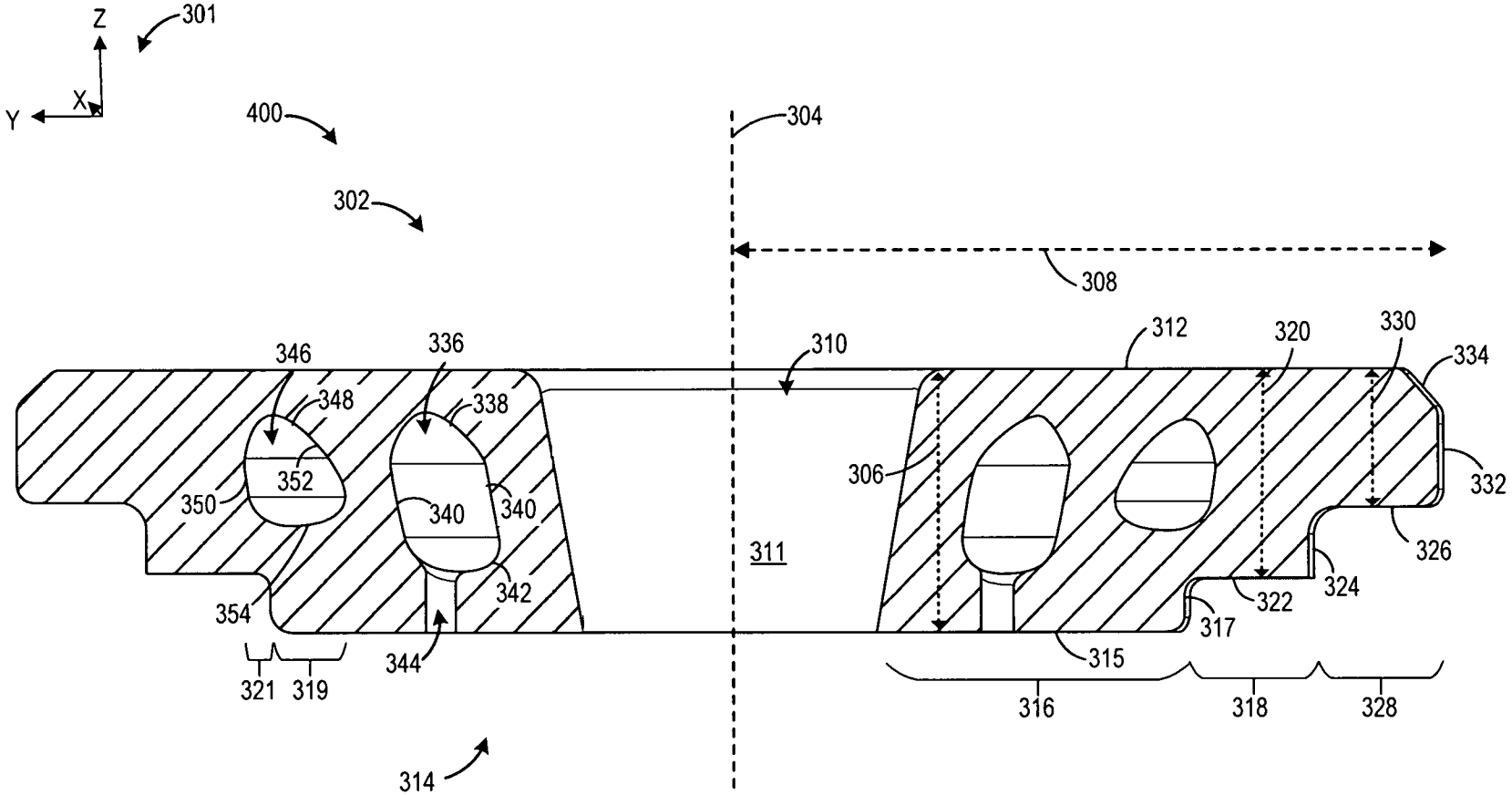
FIG. 4 shows a second cross-section of a hollow valve spring retainer from a front view.
Figure 5:
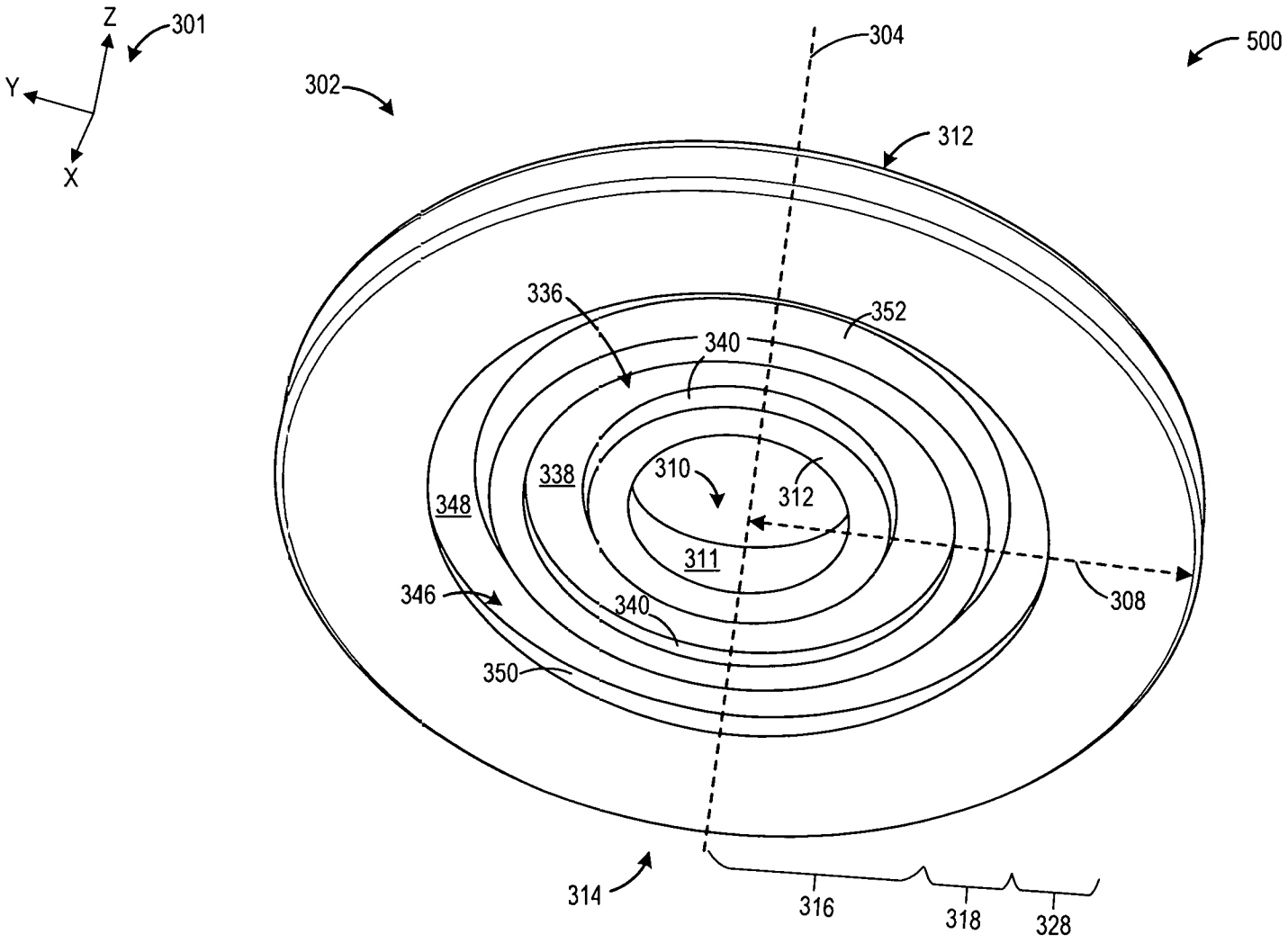
FIG. 5 shows a third cross-section of a hollow valve spring retainer from a bottom view.

The following description relates to a hollow valve spring retainer for a poppet valve assembly. The valve spring retainer may be included in a valvetrain of an engine system, such as the engine system illustrated in FIG. 1. A positioning of the valve spring retainer relative to a valve stem and a valve spring of a poppet valve, such as an intake valve or an exhaust valve of a combustion chamber, is shown in cut-away views of FIGS. 2A and 2B. The poppet valve is shown in a closed position in FIG. 2A and in an open position in FIG. 2B to illustrate how the valve spring retainer may assist in valve movement. Furthermore, a positioning of the poppet valve assembly at a port of the combustion chamber may allow the poppet valve assembly to control flow of air in or flow of exhaust gas out of the combustion chamber. FIGS. 3-5 depict cross-sections of the hollow valve spring retainer from different views and planes, showing details of internal cavities of the hollow valve spring retainer that may result in a reduced mass of the hollow valve spring retainer.

FIGS. 2A-5 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Figure 1:
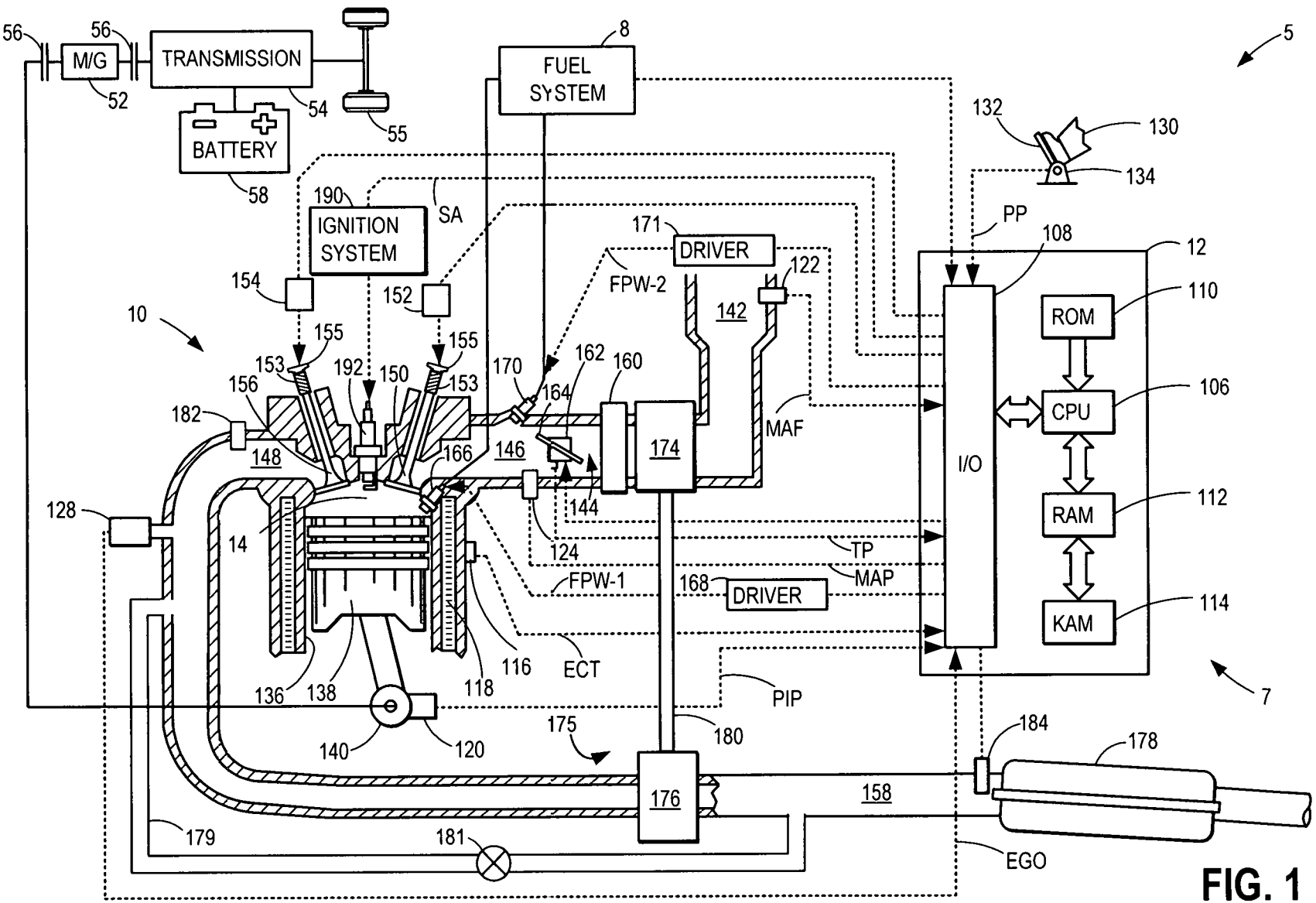
FIG. 1 shows an example engine system in which a hollow valve spring retainer may be used.

A vehicle may include an engine system comprising an engine coupled between an intake system and an exhaust system. Vehicle motion may be propelled by combustion of air and fuel at combustion chambers, e.g., cylinders, of the engine. Flow of air from the intake system to the combustion chambers and delivery of exhaust gas from the combustion chambers to the exhaust system may be controlled by adjustment of intake and exhaust valves at the cylinders. An example of a vehicle with such components is shown in FIG. 1. FIG. 1 depicts an example of a cylinder of internal combustion engine 10 included by engine system 7 of vehicle 5. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder 14 (which may be referred to herein as a combustion chamber) of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor (not shown) may be coupled to crankshaft 140 via a flywheel to enable a starting operation of engine 10.

Cylinder 14 may receive intake air via a series of intake air passages 142, 144, and 146. Intake air passage 146 may communicate with other cylinders of engine 10 in addition to cylinder 14. FIG. 1 shows engine 10 configured with a turbocharger 175 including a compressor 174 arranged between intake passages 142 and 144, and an exhaust turbine 176 arranged along the exhaust system between an exhaust manifold 148 and an exhaust pipe 158. Compressor 174 may be mechanically coupled to turbine 176 by a shaft 180. A speed of compressor 174 may be regulated by a wastegate 181, arranged in an exhaust system of the engine system 7. In some examples, turbocharger 175 may be an electric turbocharger and at least partially powered by an electric motor.

A charge air cooler (CAC) 160 may be positioned in intake passage 142 downstream of compressor 174 and upstream of a throttle 162. The CAC 160 may be an air-to-air CAC or a liquid-cooled CAC, configured to cool and increase a density of air compressed by the compressor 174. The cooled air may be delivered to the engine 10 and combusted at cylinder 14.

Throttle 162, including a throttle plate 164, may be provided along an intake passage of the engine for varying the flow rate and/or pressure of intake air provided to the engine cylinders. For example, throttle 162 may be positioned downstream of compressor 174 as shown in FIG. 1, or alternatively may be provided upstream of compressor 174.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder.

Intake valve 150 may be controlled by controller 12 via actuator 152. Similarly, exhaust valve 156 may be controlled by controller 12 via actuator 154. During some conditions, controller 12 may vary the signals provided to actuators 152 and 154 to control the opening and closing of the respective intake and exhaust valves. The position of intake valve 150 and exhaust valve 156 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 14 may alternatively include an intake valve controlled via electric valve actuation and an exhaust valve controlled via cam actuation including CPS and/or VCT. In other examples, the intake and exhaust valves may be controlled by a common valve actuator or actuation system, or a variable valve timing actuator or actuation system.

In some examples, intake valve 150 and exhaust valve 156 may each include a valve spring 153 that exerts compressive forces against a surface of the cylinder 14 to seal the valves against intake and exhaust ports of the cylinder 14 when the valves are actuated to closed positions. The valve springs 153 may coil around stems of the intake and exhaust valves 150, 156. A valve spring retainer 155 may be positioned directly above the valve spring 153 at a top of each of the intake and exhaust valves 150, 156 and may be used to anchor a position of a top end of the valve spring 153 along the valve. In this way, the valve spring retainer enables the valve spring position to be held along a valve stem. Example embodiments of a hollow valve spring retainer are shown in FIGS. 2A-5 and will be described in further detail below.

Cylinder 14 may have a compression ratio, which is the ratio of volumes when piston 138 is at bottom center to top center. In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 for initiating combustion. Ignition system 190 can provide an ignition spark to cylinder 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some examples, each cylinder of engine 10 may be configured with one or more fuel injectors for providing fuel thereto. As a non-limiting example, cylinder 14 is shown including two fuel injectors 166 and 170. Fuel injectors 166 and 170 may be configured to deliver fuel received from fuel system 8. Fuel system 8 may include one or more fuel tanks, fuel pumps, and fuel rails. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 14. While FIG. 1 shows injector 166 positioned to one side of cylinder 14, it may alternatively be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a fuel tank of fuel system 8 via a high pressure fuel pump, and a fuel rail. Further, the fuel tank may have a pressure transducer providing a signal to controller 12.

Fuel injector 170 is shown arranged in intake passage 146, rather than in cylinder 14, in a configuration that provides what is known as port fuel injection (hereafter referred to as "PFI") into the intake port upstream of cylinder 14. Fuel injector 170 may inject fuel, received from fuel system 8, in proportion to the pulse width of signal FPW-2 received from controller 12 via electronic driver 171. Note that a single driver 168 or 171 may be used for both fuel injection systems, or multiple drivers, for example driver 168 for fuel injector 166 and driver 171 for fuel injector 170, may be used, as depicted.

In an alternate example, each of fuel injectors 166 and 170 may be configured as direct fuel injectors for injecting fuel directly into cylinder 14. In still another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

Operation of intake valve 150 is now described in greater detail. The intake valve 150 may be moved from a fully open position to a fully closed position, or to any position there-between. Assuming all other conditions and parameters are constant (e.g., for a given throttle position, vehicle speed, manifold pressure, etc.), the fully open position of the valve allows more air from the intake passage 146 to enter the cylinder 14 than any other position of the intake valve 150. Conversely, the fully closed position may prevent air flow (or allow the least amount of air) from the intake passage 146 into the cylinder 14 relative to any other position of the intake valve 150. Thus, the positions between the fully open and fully closed position may allow varying amounts of air to flow between the intake passage 146 to the cylinder 14. In one example, moving the intake valve 150 to a more open position allows more air to flow from the intake passage 146 to the cylinder 14 than its initial position.

The exhaust valve 156 may also be moved from a fully open position to a fully closed position, or to any position there-between. Adjusting the exhaust valve 156 to the fully open position allows more exhaust gas from the cylinder 14 to enter exhaust manifold 148 than any other position of the exhaust valve 156. When the exhaust valve 156 is in the fully closed position, flow of exhaust gas from the cylinder 14 to exhaust manifold 148 may be blocked. The positions between the fully open and fully closed positions may thereby allow varying amounts of exhaust gas to either flow form the cylinder 14 to exhaust manifold 148, or be retained as residuals in the cylinder.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof etc. One example of fuels with different heats of vaporization could include gasoline as a first fuel type with a lower heat of vaporization and ethanol as a second fuel type with a greater heat of vaporization. In another example, the engine may use gasoline as a first fuel type and an alcohol containing fuel blend such as E85 (which is approximately 85% ethanol and 15% gasoline) or M85 (which is approximately 85% methanol and 15% gasoline) as a second fuel type. Other feasible substances include water, methanol, a mixture of alcohol and water, a mixture of water and methanol, a mixture of alcohols, etc.

As the mixture of intake air and fuel is combusted at cylinder 14, exhaust valve 156 may be commanded to open and flow exhaust gas from cylinder 14 to exhaust manifold 148. The opening of the exhaust valve 156 may be timed to open before intake valve 150 is fully closed so that there is a period of overlap when both valves are at least partially open. The overlap may generate a weak vacuum that accelerates the air-fuel mixture into the cylinder, e.g., exhaust scavenging. The period of valve overlap may be timed in response to engine speed, camshaft valve timing, and configuration of the exhaust system. Exhaust manifold 148 can receive exhaust gases from other cylinders of engine 10 in addition to cylinder 14. The exhaust gas channeled from cylinder 14 to exhaust manifold 148 may flow to turbine 176 or bypass turbine 176 via bypass passage 179 and wastegate 181.

Exhaust gas that is directed to turbine 176 may drive the rotation of turbine 176 when wastegate 181 is closed, thereby spinning compressor 174. Alternatively, when wastegate 181 is at least partially open, e.g., adjusted to a position between fully closed and fully open, or fully open, a portion of the exhaust gas may be diverted around turbine 176 through bypass passage 179. Shunting exhaust flow through bypass passage 179 may decrease the rotation of turbine 176, thereby reducing the amount of boost provided to intake air in intake passage 142 by compressor 174. Thus during events where a rapid decrease in boost is desired, e.g., an tip-out at input device 132, turbine 176 may be decelerated by opening wastegate 181 and reducing the amount of exhaust gas directed to turbine 176.

Wastegate 181 is disposed in bypass passage 179 which couples exhaust manifold 148, downstream exhaust gas sensor 128, to an exhaust pipe 158, between turbine 176 and emission control device 178. Spent exhaust gas from turbine 176 and exhaust gas routed through bypass passage 179 may convene in exhaust pipe 158 upstream of emission control device 178 before catalytic treatment at emission control device 178.

Exhaust gas sensor 128 is shown coupled to exhaust manifold 148 upstream of turbine 176 and a junction between bypass passage 179 and exhaust manifold 148. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example, before treatment at emission control device 178. Emission control device 178 may be a three way catalyst (TWC), NOx trap, various other emission control devices, or combinations thereof, configured to remove undesirable chemicals from the exhaust gas prior to atmospheric release.

The valves described above and other actuatable components of vehicle 5 may be controlled by controller 12. Controller 12 is shown in FIG. 1 as a microcomputer, including microprocessor unit 106, input/output ports 108, an electronic storage medium for executable programs and calibration values shown as non-transitory read only memory chip 110 in this particular example for storing executable instructions, random access memory 112, keep alive memory 114, and a data bus. Controller 12 may receive various signals from the various sensors coupled to engine 10 depicted at FIG. 1, as well as sensors 16 shown and described in FIGS. 2A-2B. In addition to those signals previously discussed, the controller may receive signals including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold. Exhaust manifold pressure may be measured by a pressure sensor 182 and pressure in the exhaust pipe 158 measured by another pressure sensor 184. Controller 12 may infer an engine temperature based on an engine coolant temperature.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

In some examples, vehicle 5 may be a hybrid vehicle with multiple sources of torque available to one or more vehicle wheels 55. In other examples, vehicle 5 is a conventional vehicle with only an engine. In the example shown, vehicle 5 includes engine 10 and an electric machine 52. Electric machine 52 may be a motor or a motor/generator. Crankshaft 140 of engine 10 and electric machine 52 are connected via a transmission 54 to vehicle wheels 55 when one or more clutches 56 are engaged. In the depicted example, a first clutch 56 is provided between crankshaft 140 and electric machine 52, and a second clutch 56 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from an energy storage device 58 (herein, battery 58) to provide torque to vehicle wheels 55. Electric machine 52 may also be operated as a generator to provide electrical power to charge battery 58, for example during a braking operation.

Figure 2B:
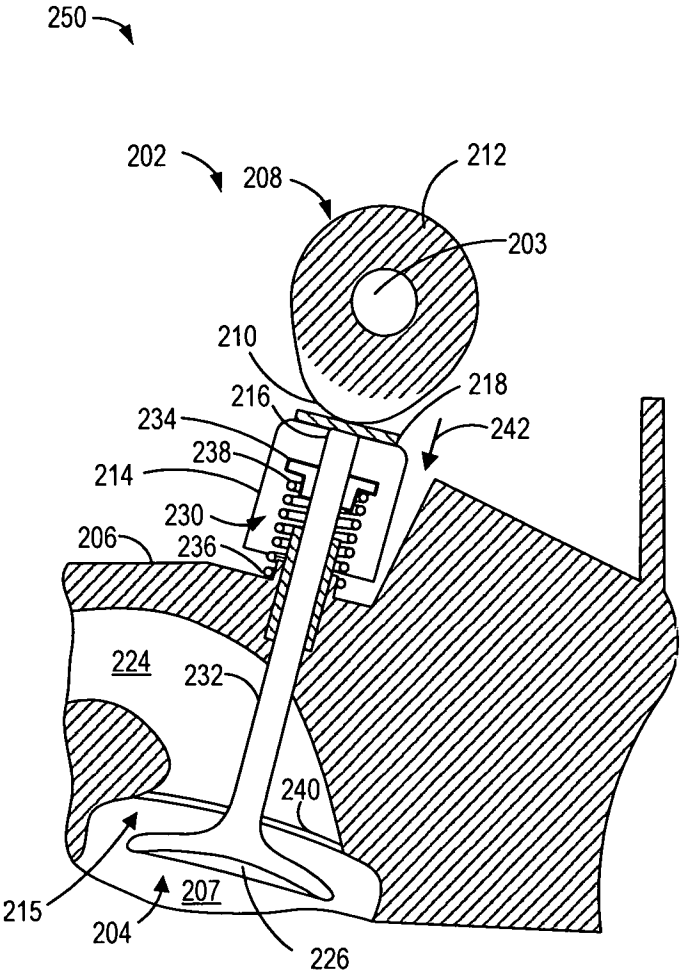
FIG. 2B shows a second cut-away view of a valvetrain with a valve adjusted to an open position, the valve adapted with a valve spring retainer.
Figure 2A:
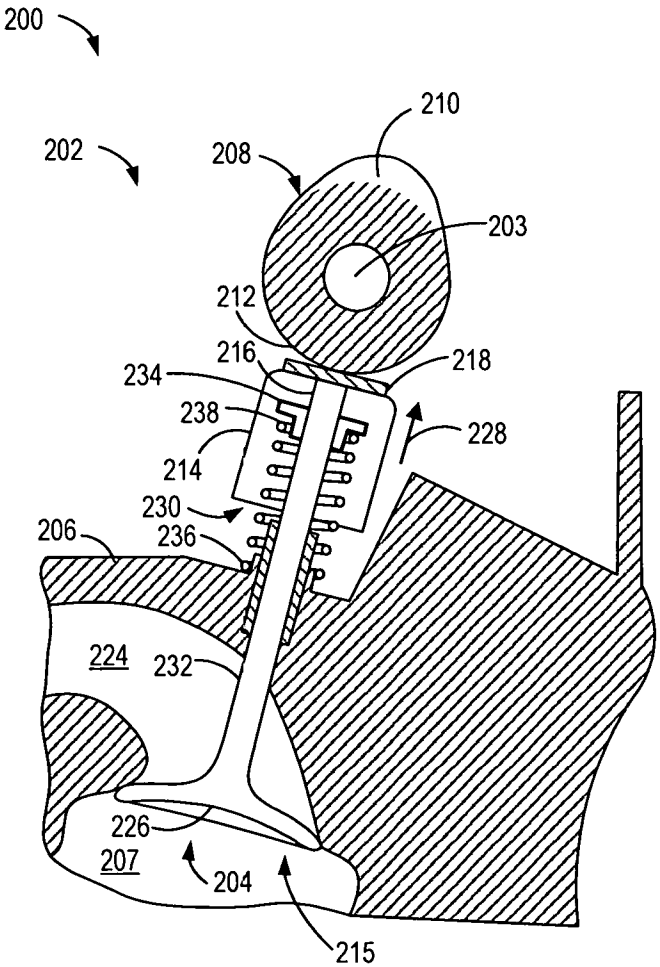
FIG. 2A shows a first cut-away view of a valvetrain with a valve adjusted to a closed position, the valve adapted with a valve spring retainer.

The controller 12 receives signals from the various sensors of FIG. 1 and FIGS. 2A-2B, and employs the various actuators of FIG. 1, as well as actuators of FIGS. 2A-2B, to adjust engine operation based on the received signals and instructions stored on a memory of the controller. For example, the controller may use the PIP signal and information from the position sensor of the intake valve 150 to determine a fuel injection timing. As another example, signals from the position sensors of the intake valve 150 and exhaust valve 156 may be used to adjust a spark timing.

Opening and closing of an intake and/or an exhaust valve (hereafter, referred to collectively as a valve) may affect engine operations such as spark timing, fuel injection timing, as described above, as well as power output and performance of the engine. Ensuring that the valve seals against an intake or an exhaust port of a cylinder when the valve is closed may reduce a likelihood of air/fuel ratios deviating from a target air/fuel ratio (e.g., stoichiometry) during combustion. Adapting the valve with a valve spring may improve a sealing engagement of the valve with the intake or exhaust port. In order to maintain a desired compressive force on the valve by the valve spring so that the valve presses securely against the port, the valve may also include a valve spring retainer. The valve spring retainer may be arranged immediately above and in contact with a top end of the valve spring and may resist displacement along the valve. A positioning of the valve spring retainer is shown in greater detail in FIGS. 2A-2B in partial cut-away views of a valvetrain 202.

Valvetrain 202 may include one or more camshafts configured with camshaft lobes to control positions of intake and exhaust valves of a cylinder. A dual overhead camshaft arrangement is shown in the examples of FIGS. 2A-2B but other examples may include alternate positioning of the camshaft, such as a single overhead camshaft or a pushrod system with the camshaft arranged below the intake and exhaust valves. A first cut-away view 200 of the valvetrain 202 is shown in FIG. 2A with a valve 204 in a closed position. The valve 204 may be the intake valve 150 or the exhaust valve 156 of FIG. 1 and may be arranged in a cylinder head 206 of a cylinder 207. A cam lobe 208, rotating around a camshaft 203, may be positioned above the cylinder head 206 and may be one of a plurality of cam lobes attached to the camshaft 203. The cam lobe 208 may have an elongate, tapered end 210 and a rounded end 212. In the first cut-away view 200, the cam lobe 208 is shown rotated to a position so that the rounded end 212 is in contact with a cam follower 214 arranged at an upper end 216 of the valve 204. The cam follower 214 may be shaped as a cap that encloses the upper end 216 of the valve 204.

The valve 204 may extend between the cam lobe 208 and a port 224 which may be an intake port or an exhaust port. The port 224 is fluidly coupled to the cylinder 207 and a flange 226 of the valve 204 is arranged at a merging region 215 of the port 224 and the cylinder 207. A diameter of the flange 226 may be at least equal to or slightly larger than a diameter of the port 224 in the merging region 215 so that when the valve 204 is closed, as shown in FIG. 2A, flow between the port 224 and the cylinder 207 is blocked.

The valve 204 may move up or down relative to the region where the port 224 and the cylinder 207 merge. The motion is controlled by a translation of rotation of the cam lobe 208, actuated by rotation of the camshaft 203, to linear motion of the valve 204. For example, in FIG. 2A, the cam lobe 208 is rotated so that the rounded end 212, with a smaller diameter relative to the camshaft 203 than the tapered end 210, is in contact with a shim 218. In this position, the valve 204 may be lifted, in a direction indicated by arrow 228 so that the flange 226 seals the port 224 from the cylinder 207. Lifting of the valve 204 as the cam lobe 208 rotates to the position shown in FIG. 2A may be assisted by a valve spring 230.

The valve spring 230 coils around a valve stem 232 of the valve 204, extending between a surface of the cylinder head 206 and a valve spring retainer 234. The valve spring retainer 234 may be substantially disc-shaped with the valve stem 232 inserted through a central aperture of the valve spring retainer 234. The valve spring retainer 234 may be in a fixed position along the valve stem 232. That is, the valve spring retainer 234 does not slide along the valve stem 232, which, in some examples, may be achieved by welding the valve spring retainer 234 to the valve stem 232 so that the valve spring retainer 234 is secured to the valve stem 232 by a welded joint. Still other coupling configurations may be possible. When the valve 204 is in the lifted position, a distance that the cam follower 214 is depressed is decreased relative to when the tapered end 210 is in contact with the shim 218 of the cam follower 214, as shown in FIG. 2B. Compression of the valve spring 230 is decreased and release of at least a portion of a spring load of the valve spring 230 causes the valve spring 230 to expand along a length of the valve stem 232. A bottom end 236 of the valve spring 230 presses against the surface of the cylinder head 206 while a top end 238 of the valve spring 230 presses against the valve spring retainer 234 as the valve spring 230 expands. As a result, the valve 204 slides upwards, the upward motion halted by contact of the flange 226 against a valve seat 240, the valve seat 240 shown in FIG. 2B. In this position, the valve 204 is closed.

In a second cut-away view 250 shown in FIG. 2B, the cam lobe 208 is rotated so that the tapered end 210 of the cam lobe 208 is in contact with the shim 218 of the cam follower 214. The cam follower 214 is depressed, in a direction indicated by arrow 242, relative to the position of the cam follower 214 shown in FIG. 2A. The depression of the cam follower 214 results in sliding of the valve 204 also along the direction indicated by arrow 242, and shifting of the flange 226 of the valve 204 below the valve seat 240 so that the flow between the port 224 and the cylinder 207 is no longer blocked by the valve 204. In this position, the valve 204 is open.

It will be appreciated that the closed and open positions of FIGS. 2A and 2B, respectively, represent boundaries to the movement of the valve 204. In other words, the positions of the valve 204 in FIGS. 2A and 2B show fully closed and fully open orientations, respectively. When the earn lobe 208 rotates so that surfaces of the cam lobe 208 between a central region of the rounded end 212, as shown in FIG. 2A, and a central region of the tapered end 210, as shown in FIG. 2B, are in contact with the shim 218 of the cam follower 214, the valve 204 may slide continuously through a range of positions between fully open and fully closed.

In the open position, the valve spring 230 may be compressed between the valve spring retainer 234 and the surface of the cylinder head 206. The valve spring retainer may be formed from a durable, rigid material with a relatively high heat tolerance, such as steel. Depending on a number of cylinders present, an engine system may comprise numerous valve spring retainers. In performance vehicles with a greater number of cylinders, the number of valve spring retainers may be increased accordingly, causing an undesirable increase in a weight of the valvetrain. Thus, use of valve spring retainers with reduced mass may offset a decrease in engine performance arising from the weight of the valve spring retainers. The mass of the valve spring retainer may be decreased by introducing inner cavities, thereby reducing an amount of material used to form the valve spring retainer. The hollow valve spring retainer may be nonetheless able to maintain a tensile strength and resist deformation caused by pressure exerted on the valve spring retainer by the valve spring.

The hollow valve spring retainer may be fabricated by additive manufacturing, such as 3D printing. In comparison to conventional methods of forming the valve spring retainer, such as die-casting, additive manufacturing of the valve spring retainer may allow the retainer to be readily formed with relatively thin, continuous surfaces. Less material is wasted during the manufacturing process and production labor is comparatively decreased, thereby reducing costs. Furthermore, a reduction in processing costs may at least partially balance forming the hollow valve spring retainer from more expensive metals such as titanium or nickel chromium alloys. As well, 3D printing of the valve spring retainer may allow alternate lightweight materials to be used that may be difficult to employ in conventional processing methods, such as low-density aluminum alloys.

A first cross-section 300 of a hollow valve spring retainer 302 is shown from a perspective view in FIG. 3. A set of reference axes 301 is provided for comparison between views shown in FIGS. 3-5, indicating a y-axis, a z-axis axis and an x-axis. The first cross-section 300 is taken along a z-y-plane. The valve spring retainer 302 has a central axis 304 that is co-axial with the z axis. Elements in common between the views of the valve spring retainer 302 depicted in FIGS. 3-5 are similarly numbered and will not be re-introduced beyond the initial description for brevity.

The hollow valve spring retainer 302 may be configured as a disc, or a solid torus, with a central circular aperture 310. An outer diameter 303 of the valve spring retainer at an edge wall 332 is larger than an inner diameter 305 of the valve spring retainer at an aperture wall 311. The disc may have an upper face 312 that is planar and a lower face 314 that is stepped and includes a number of concentric sections (e.g., concentric with the central aperture 310), each section have a different thickness. Each concentric section is distinct from adjacent sections by the stepped geometry of the lower face 314 where each section is divided from adjacent sections by substantially perpendicular adjoining surfaces. A section that is proximate to the aperture wall 311 forms a thickest region of the valve spring retainer 302, with a thickness 306 measured along the z-axis. Each concentric section that is arranged outside of an inner adjacent section (e.g., further from the aperture wall 311 and closer to the edge wall 332) is thinner than the inner section. Thus the outermost section proximate to the edge wall 332 may form a thinnest portion of the valve spring retainer 302. It will be appreciated that while the valve spring retainer shown in FIGS. 3-5 is depicted with three stepped sections, other examples of the valve spring retainer may have more or less than three sections and transitions between the sections may be more gradual. For example, instead of sections that form distinct steps of varying thicknesses, the thickness of the valve spring retainer may gradually decrease from the aperture wall 311 to the edge wall 221.

The thickness 306 (at a thickest region of the valve spring retainer 302 proximate to the aperture 310) is a distance between the upper face 312 and the lower face 314 that is smaller than a radius 308 of the valve spring retainer 302. The circular aperture 310 extends through the entire thickness 306 of the valve spring retainer 302, through a central region of the valve spring retainer 302. The central axis 304 may be centered within the circular aperture 310, the central axis 304 extending along the thickness 306 of the thickest section of the valve spring retainer 302. The aperture wall 311 may have a plane that is slightly angled relative to the central axis 304. The angle of the plane of the aperture wall 311, as shown in a second cross-section 400 of the valve spring retainer 302 in FIG. 4 (also taken along the z-y-plane), may result in a diameter of the aperture at an upper face 312 of the valve spring retainer 302 being larger than a diameter of the aperture 310 at a lower face 314 of the valve spring retainer 302.

A first step 316 of the lower face 314 of the valve spring retainer 302 may be disposed at an innermost edge of the valve spring retainer 302, immediately adjacent to and surrounding the aperture 310. A third step 328 is disposed at an outermost edge of the valve spring retainer 302, inside of the edge wall 332, and a second step 318 is positioned between the first step 316 and the third step 328. The first step 316 may form a portion of the radius 308 of the valve spring retainer 302 representing the thickest (e.g., having the thickness 306) section of the valve spring retainer 302. The first step 316 may extend circumferentially around the aperture 310 and have a width, measured along the y-axis, that is at least a third of the total radius 308 of the valve spring retainer 302. A bottom surface 315 of the first step 316 may be parallel with the upper face 312 of the valve spring retainer 302 while a side wall 317 of the first step 316 may be substantially perpendicular to the bottom surface 315.

The first step 316 may be circumferentially surrounded by the second step 318 that has a thickness 320 that is thinner than the thickness 306 of the first step 316. The bottom surface 315 of the first step 316 extends into the side wall 317 of the first step 316 along an outer circumference of the first step 316. In addition, the side wall 317 of the first step may extend into a bottom surface 322 of the second step 318, the bottom surface 322 parallel with the upper face 312 of the valve spring retainer 302. The bottom surface 322 of the second step 318 may extend into a side wall 324 of the second step 318 that is perpendicular to the bottom surface 322 of the second step 318 of the valve spring retainer 302. The side wall 324 may be an outer circumference of the second step 318. A width of the second step 318, defined along the y-axis, may be a third or less of the radius 308 of valve spring retainer 302. The side wall 324 of the second step 318 may couple to a bottom surface 326 of a third step 328 that is also parallel with the upper face 312 of the valve spring retainer 302.

The third step 328 may circumferentially surround the second step 318 and may be a thinnest section of the valve spring retainer 302, with a thickness 330. The thickness 330 of the third step 328 is less than both the thicknesses 320, 306 of the second and first steps 318, 316, respectively, with the thickness 320 of the second step 316 intermediate of the thickness 306 of the first step 316 and the thickness 330 of the third step 328. A width of the third step 328, defined along the y-axis, may comprise a third or less of the radius 308 of the valve spring retainer 302. The third step 328 may also be an outermost section of the valve spring retainer 302, surrounded by the edge wall 332. A total width of the valve spring retainer 302 is a sum of the widths of each of the first, second, and third sections 316, 318, 328 and an overall height, defined along the z-axis, of the valve spring retainer 302 is the thickness 306 of the first step 316. The edge wall 332 is parallel to the z-axis and coupled to the upper face 312 by a bevel 334 that is beveled with respect to the z-axis. In other examples, the edge wall 332 may be coupled to the upper face 312 by a surface that is chamfered.

The stepped geometry of the lower face 314 of the valve spring retainer 302 may allow a valve spring, such as the valve spring 230 of FIGS. 2A-2B, to be retained by the valve spring retainer 302. For example, a top end of the valve spring may engage with the lower face 314 by wrapping around the side wall 324 of the second step 318 and nesting against the bottom surface 326 of the third step 328. Alternatively, the top end of the valve spring may nest against the bottom surface 322 of the second step 318 and wrap around the side wall 317 of the first step 316, depending on a diameter of the valve spring. A position of the top end of the valve spring is thereby maintained by the valve spring retainer 302.

To reduce a mass of the valve spring retainer 302, the valve spring retainer 302 may be at least partially hollowed by configuring the valve spring retainer 302 with a plurality of inner cavities in addition to the central aperture 310. A first cavity 336 is shown in FIGS. 3-5, arranged within the thickness 306 of the first step 316 of the valve spring retainer 302. A cross-section of the first cavity 336, taken along the z-y-plane or z-x-plane, may have a rounded, irregular geometry. The first cavity 336 may be coaxial with the valve spring retainer 302, e.g., the central axis 304 of the valve spring retainer 302 is also a central axis of the first cavity 336, and may form a continuous circular channel extending through the first step 316 of the valve spring retainer 302.

The first cavity 336 may have a top surface, or ceiling, 338 that may curve upwards, as shown in FIGS. 3 and 4. The ceiling 338 may be tapered with a width, defined along the y-direction, that is narrowest at a top of the ceiling 338 and widest where the ceiling couples to side walls 340 of the first cavity 336. In other examples, however, the ceiling 338 of the first cavity 336 may be co-planar with the upper face 312 of the valve spring retainer 302. The ceiling 338 may couple to top ends of side walls 340 of the first cavity 336 that are straight and substantially co-planar with the aperture wall 311. Bottom ends of side walls 340 may couple to a bottom surface, or floor, 342 of the first cavity 336. The floor 342 may curve downwards, in an opposite direction from the curvature of the ceiling 338 of the first cavity 336 and may curve without tapering. The floor 342 may include at least one channel 344 that extends from the floor 342 of the first cavity 336 to the bottom surface 315 of the first step 316.

The channel 344 may be a passageway for exchange of air between the first cavity 336 and the surroundings of the valve spring retainer 302. In one example, the channel 344 may have a circular cross-section, taken along the y-x-plane, that fluidly couples air inside the first cavity 336 to air surrounding, e.g., outside of, the valve spring retainer 302. By configuring the first cavity 336 with at least one channel 344, pressure that may accumulate within the first cavity 336 during heating of the valve spring retainer 302 may be equalized with ambient air surrounding the valve spring retainer 302. For example, heat may be transferred from the cylinders, where combustion occurs, to components that are proximate to or in contact with the cylinders, such as intake and exhaust valves, valve springs, and valve spring retainers. Heating of the valve spring retainer 302 may cause air contained within the first cavity 336 to expand. The heated, expanded, air may be vented out of the first cavity 336 through the channel 344, thus reducing forces exerted on surfaces of the first cavity 336 from the heated air.

While the valve spring retainer 302 of FIGS. 3-5 includes two channels, it will be appreciated that the valve spring retainer may include more or less of the channels, such as 1, 5, or 8, etc., without departing from the scope of the present disclosure. Furthermore, the examples of the valve spring retainer 302 shown in FIGS. 3-5 are non-limiting examples, and numerous variations in the alignment, position, size, shape and dimensions of the first cavity 336, as well as the channel 344, have been envisioned. As an example, the first cavity 336 may not be a single continuous channel around the valve spring retainer 302 and may instead comprise two or more sections encircling the aperture 310 within the first step 316 of the valve spring retainer 302.

The valve spring retainer 302 may include a second cavity 346 arranged between the first cavity 336 and the edge wall 332 of the valve spring retainer 302 and spaced away from both the first cavity 336 and the edge wall 332. The second cavity 346 may concentrically surround the first cavity 336 and both the first cavity 336 and the second cavity 346 may be concentric about the central aperture 310 of the valve spring retainer 302. The second cavity 346 may be partially disposed within the thickness 306 of the first step 316 and extend partially into the thickness 320 of the second step 318. In other words, a first portion 319 of the second cavity 346 may be located within the first step 316 and a second portion 321 may be located within the second step 318, as shown in FIG. 4. As a result of the partial extension of the second cavity 346 into the thinner second step 318 (e.g., thinner than the first step 316), a height of the second cavity 346, defined along the z-axis, may be less than a height of the first cavity 336.

A geometry of a cross-section of the second cavity 346 may be irregularly shaped, as shown in FIGS. 3 and 4. For example, an upper surface, or ceiling 348, of the second cavity 346 may curve upwards and taper so that a top of the ceiling 348 is narrower, as defined along the y-axis, than a base of the ceiling 348 where the ceiling 348 couples to top ends of a first side wall 350 and a second side wall 352 of the second cavity 346. The first side wall 350 and second side wall 352 may not be co-planar. Instead, as shown in FIGS. 3 and 4, the first side wall 350 of the second cavity 346 may be substantially co-planar with the side walls 340 of the first cavity 336. The second side wall 352 of the second cavity 346, however, may be angled with respect to the first side wall 350 and form a larger angle relative to the z-axis than the first side wall 350. The angling of the second side wall 352 may result in a bottom surface, or floor, 354 of the second cavity 346 that is wider than the ceiling 348.

Bottom ends of the first side wall 350 and the second side wall 352 may be coupled to the floor 354 of the second cavity 346. The floor 354 may curve downwards, in an opposite direction from the curvature of the ceiling 348 of the second cavity 346 and, unlike the ceiling 348, may not taper. A bottom-most point of the floor 354 of the second cavity 346 may be higher than a bottom-most point of the floor 342 of the first cavity 336, resulting in a shorter height of the second cavity 346, the height defined along the z-axis. As well, the cross-section of the second cavity 346 is formed from asymmetric surfaces, resulting in the irregular shape of the second cavity 346. Although not shown in FIGS. 3 and 4, the floor 354 of the second cavity 346 may include one or more channels, similar to channel 344 of the first cavity 336. A placement of the channel 344 of the second cavity 346 may be offset from a placement of the channel 344 of the first cavity 336. For example, the channel of the second cavity 346 may be angled with respect to the x-axis along the y-x-plane so that the cross-sections 300 and 400 of FIGS. 3 and 4 do not dissect the channel(s) of the second cavity 346.

The channel 344 of the second cavity 346 may extend from the floor 354 of the second cavity 346 to a region of the lower face 314 of the valve spring retainer 302, such as the bottom surface 322 of the second step 318 of the valve spring retainer 302. The channel 344 of the second cavity 346 may fluidly couple air inside the second cavity 346 to air surrounding the valve spring retainer 302, providing one or more vents to equalize pressure within the second cavity 346 with ambient air surrounding the valve spring retainer 302 when the valve spring retainer 302 is heated and air inside the second cavity 346 expands.

A third cross-section 500 of the valve spring retainer 302 is shown in FIG. 5, taken along a y-x-plane. The circular extension of the first cavity 336 through the portion of the valve spring retainer 302 formed by the first step 316 is illustrated in the third cross-section 500, depicting the co-axial arrangement of the first cavity 336 with the valve-spring retainer 302, relative to the central axis 304. A concentric, circular extension of the second cavity 346 around the first cavity 336, through both a portion of the first step 316 and a portion of the second step 318, is also shown, with the second cavity 346 spaced away from the first cavity 336 by the material of the valve spring retainer 302. The second cavity 346 is positioned closer to the edge wall 332 than the first cavity 336. The first cavity 336 and the ceiling 348 of the second cavity 346 may be co-planar, both aligned with the y-x-plane, and co-axial, both centered about the central axis 302.

As described previously for the first cavity 336 of the valve spring retainer 302, the examples of the second cavity 346 shown in FIGS. 3-5 are non-limiting examples of the second cavity 346 and variations in a size, shape, geometry, and continuity of the second cavity 346 have been contemplated. In addition, more or less cavities may be disposed in the valve spring retainer 302 while maintaining a reduction in mass of the valve spring retainer 302 and without degrading a structural integrity of the valve spring retainer 302. For example, the valve spring retainer 302 may include a single, large volume cavity or 3 cavities, each of smaller volumes than the first and second cavities 336, 346 shown. As another example, the first cavity 336 may be a continuous channel within the valve spring retainer 302 while the second cavity 346 may be formed from two or more sections that are separated by the material of the valve spring retainer 302 so that the sections of the second cavity 346 do not fluidly communicate with one another. Each of the sections of the second cavity 346 may include a channel, such as the channel 344 of the first cavity 336, that provides a passageway for venting of expanded air from each of the sections of the cavity to ambient air surrounding the valve spring retainer 302. Numerous combinations including variations in the configurations of the cavities have been envisioned.

In this way, a valve spring retainer may be configured to be at least partially hollowed, thereby reducing a mass of the valve spring retainer without affecting a capacity of the valve spring retainer to support a valve spring. The valve spring retainer may comprise one or more inner cavities, forming one or more channels of space within a thickness of the valve spring retainer. The inner cavities reduce a material requirement of the valve spring retainer, reducing associated manufacturing costs without compromising on the structural integrity of the retainer. Further, the inner cavities and any associated channels enable exchange of air between the inner cavities and air surrounding the valve spring retainer. This allows a pressure within the cavities to be equalized with ambient air when the valve spring retainer is heated, such as during high load engine operation. The valve spring retainer maybe formed from a continuous, single piece of material, allowing the valve spring retainer to be fabricated as a single unit by additive manufacturing. As a result, costs and time associated with production of the valve spring retainer are significantly reduced. The technical effect of adapting an engine with a hollow valve spring retainer is that an overall mass of a valvetrain may be decreased, thereby reducing a spring load of valve springs and reducing friction generated between valvetrain components.

In one embodiment, a valvetrain of an engine may include a valve spring, a disc-shaped valve spring retainer having a central aperture and a plurality of inner cavities concentric with the central aperture, the retainer engaging with a first end of the valve spring. In a first example of the valvetrain, the plurality of inner cavities form continuous air channels encircling the central aperture of the valve spring retainer, each of the inner cavities further including a channel coupling the air channel of the corresponding inner cavity to ambient air surrounding the retainer. A second example of the valvetrain optionally includes the first examples, and further includes wherein each of the plurality of inner cavities are spaced apart from one another, separated by a material of the valve spring retainer. A third example of the valvetrain optionally includes one or more of the first and second examples, and further includes, wherein the plurality of inner cavities have upwardly curving ceilings and downwardly curving floors, the ceilings and floors of the inner cavities coupled by side walls. A fourth example of the valvetrain optionally includes one or more of the first through third examples, and further includes, wherein the valve spring is coupled to a valve stem of a valve, and a position of the valve spring retainer along the valve stem is maintained via secure attachment of the retainer to the valve stem, the secure attachment including a welded joint. A fifth example of the valvetrain optionally includes one or more of the first through fourth examples, and further includes, wherein the first end of the valve spring is away from a cylinder head, the valve spring further including a second end, opposite the first end, the second end in contact with a surface of a cylinder head, and wherein the valve spring exerts a spring load on the valve spring retainer at the first end of the valve spring and on the surface of the cylinder head at the second end. A sixth example of the valvetrain optionally includes one or more of the first through fifth examples, and further includes, wherein the valve spring retainer is welded to the valve stem so that the valve spring retainer resists displacement from the valve spring and the spring load of the valve spring is translated to motion of the valve. A seventh example of the valvetrain optionally includes one or more of the first through sixth examples, and further includes, wherein the valve spring retainer has a planar top face and a stepped lower face, the stepped lower face forming a thickest portion of the valve spring retainer proximate to the central aperture and a thinnest portion proximate to an outer edge of the valve spring retainer.

As another embodiment, a hollow valve spring retainer includes a toroid unit with a central aperture for receiving a valve stem, a first and a second hollow cavity, each concentric with the central aperture, the first cavity positioned within the toroid unit at a different distance from the central aperture than the second channel. In a first example of the valve spring retainer, the central aperture extends from a top face to a bottom face of the unit, and wherein the first cavity is positioned within the toroid unit closer to the central aperture while the second channel is positioned within the toroid unit closer an outer edge wall of the valve spring retainer. A second example of the valve spring retainer optionally includes the first example, and further includes wherein the bottom face of the toroid unit is stepped, a diameter of the toroid unit at the outer edge wall being larger than the diameter at a circumference of the inner-most step, the diameter decreasing from the top face to the bottom face in a step-wise manner. A third example of the valve spring retainer optionally includes one or more of the first and second examples, and further includes, wherein the stepped toroid unit includes a first step with a first diameter at the top face, a second step with a second diameter at the bottom face, and a third step with a third diameter intermediate of the first and second steps, and wherein the first cavity is located within the first step and the second cavity extends across both the first and second steps, with a first portion of the second cavity located within the first step and a second portion located within the second step. A fourth example of the valve spring retainer optionally includes one or more of the first through third examples, and further includes, wherein a first stepped region of the valve spring retainer forms a thickest portion of the valve spring retainer, the first stepped region proximate to the central aperture. A fifth example of the valve spring retainer optionally includes one or more of the first through fourth examples, and further includes, wherein a second stepped region of the valve spring retainer forms a region adjacent to and encircling the first stepped region that is thinner than the first stepped region. A sixth example of the valve spring retainer optionally includes one or more of the first through fifth examples, and further includes, wherein a third stepped region is arranged between the second stepped region and an outer edge wall of the valve spring retainer, the third stepped region forming a thinnest portion of the valve spring retainer. A seventh example of the valve spring retainer optionally includes one or more of the first through sixth examples, and further includes, wherein the first inner cavity is disposed within the thickness of the first stepped region and includes one or more channels extending from the first inner cavity to a bottom surface of the first stepped region. An eighth example of the valve spring retainer optionally includes one or more of the first through seventh examples, and further includes, wherein the second inner cavity is disposed in a region, extending across both the first stepped region and second stepped region and within thicknesses of the first and second stepped regions, and includes one or more channels extending from the second inner cavity to the bottom face of the valve spring retainer. A ninth example of the valve spring retainer optionally includes one or more of the first through eighth examples, and further includes, wherein the one or more channels of the first inner cavity fluidly couples air inside the first inner cavity to ambient air surrounding the valve spring retainer and the one or more channels of the second inner cavity fluidly couples air inside the second inner cavity to ambient air surrounding the valve spring retainer. A tenth example of the valve spring retainer optionally includes one or more of the first through ninth examples, and further includes, wherein the valve spring retainer is fabricated by additive manufacturing.

As another embodiment, a method includes 3D printing a hollow valve spring retainer, the hollow valve spring retainer configured with one or more concentric inner cavities, the inner cavities concentric to a central aperture of the valve spring retainer, adapting the valvetrain with the hollow valve spring retainer, the hollow valve spring retainer coupled to a valvestem of a valve, secured to the valvestem by a welded joint, and arranged above and in contact with a top end of a valve spring.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A valvetrain of an engine comprising;

a valve spring; and a disc-shaped valve spring retainer having a central aperture and a plurality of inner cavities concentric with the central aperture, the retainer engaging with a first end of the valve spring;

wherein the plurality of inner cavities includes a first cavity positioned closer to the central aperture and a second cavity positioned closer to an outer edge wall of the disc-shaped valve spring retainer.

2. The valvetrain of claim 1, wherein the plurality of inner cavities forms continuous air channels encircling the central aperture of the valve spring retainer, each of the inner cavities further including a channel coupling an air channel of the corresponding inner cavity to ambient air surrounding the retainer.

3. The valvetrain of claim 2, wherein each of the plurality of inner cavities is spaced apart from one another, separated by a material of the valve spring retainer.

4. The valvetrain of claim 1, wherein the plurality of inner cavities has upwardly curving ceilings and downwardly curving floors, the ceilings and floors of the inner cavities coupled by side walls.

5. The valvetrain of claim 1, wherein the valve spring is coupled to a valve stem of a valve, and a position of the valve spring retainer along the valve stem is maintained via secure attachment of the retainer to the valve stem, the secure attachment including a welded joint.

6. The valvetrain of claim 5, wherein the first end of the valve spring is away from a cylinder head, the valve spring further including a second end, opposite the first end, the second end in contact with a surface of the cylinder head, and wherein the valve spring exerts a spring load on the valve spring retainer at the first end of the valve spring and on the surface of the cylinder head at the second end.

7. The valvetrain of claim 6, wherein the valve spring retainer is welded to the valve stem so that the valve spring retainer resists displacement from the valve spring and the spring load of the valve spring is translated to motion of the valve.

8. The valvetrain of claim 1, wherein the valve spring retainer has a planar top face and a stepped lower face, the stepped lower face forming a thickest portion of the valve spring retainer proximate to the central aperture and a thinnest portion proximate to an outer edge of the valve spring retainer.

9. A hollow valve spring retainer, comprising;

a toroid unit with a central aperture for receiving a valve stem; and a first and a second hollow cavity, each concentric with the central aperture, the first cavity positioned within the toroid unit at a different distance from the central aperture than the second cavity;

wherein the central aperture extends from a top face to a bottom face of the toroid unit and wherein the first cavity is positioned within the toroid unit closer to the central aperture while the second cavity is positioned within the toroid unit closer to an outer edge wall of the valve spring retainer.

10. The valve spring retainer of claim 9, wherein the bottom face of the toroid unit is stepped, a diameter of the toroid unit at the outer edge wall being larger than a diameter at a circumference of an inner-most step, the diameter decreasing from the top face to the bottom face in a step-wise manner.

11. The valve spring retainer of claim 10, wherein the stepped toroid unit includes a first step with a first diameter at the top face, a second step with a second diameter at the bottom face, and a third step with a third diameter intermediate of the first and second steps, and wherein the first cavity is located within the first step and the second cavity extends across both the first and second steps, with a first portion of the second cavity located within the first step and a second portion located within the second step.

12. The valve spring retainer of claim 11, wherein a first stepped region of the valve spring retainer forms a thickest portion of the valve spring retainer, the first stepped region proximate to the central aperture.

13. The valve spring retainer of claim 12, wherein a second stepped region of the valve spring retainer forms a region adjacent to and encircling the first stepped region that is thinner than the first stepped region.

14. The valve spring retainer of claim 13, wherein a third stepped region is arranged between the second stepped region and the outer edge wall of the valve spring retainer, the third stepped region forming a thinnest portion of the valve spring retainer.

15. The valve spring retainer of claim 14, wherein the first cavity is disposed within the thickness of the first stepped region and includes one or more channels extending from the first cavity to a bottom surface of the first stepped region.

16. The valve spring retainer of claim 15, wherein the second cavity is disposed in a region, extending across both the first stepped region and the second stepped region and within thicknesses of the first and second stepped regions, and includes one or more channels extending from the second cavity to the bottom face of the valve spring retainer.

17. The valve spring retainer of claim 16, wherein the one or more channels of the first cavity fluidly couple air inside the first cavity to ambient air surrounding the valve spring retainer and the one or more channels of the second cavity fluidly couple air inside the second cavity to ambient air surrounding the valve spring retainer.

18. The valve spring retainer of claim 9, wherein the valve spring retainer is fabricated by additive manufacturing.

19. A method for a valvetrain, comprising;

3D printing a hollow valve spring retainer, the hollow valve spring retainer configured with one or more concentric inner cavities, the inner cavities concentric to a central aperture of the valve spring retainer, wherein the inner cavities include a first cavity positioned closer to the central aperture and a second cavity positioned closer to an outer edge wall of the hollow valve spring retainer; and adapting the valvetrain with the hollow valve spring retainer, the hollow valve spring retainer coupled to a valvestem of a valve, secured to the valvestem by a welded joint, and arranged above and in contact with a top end of a valve spring.

* * * * *